US009571930B2

(12) United States Patent
Gupta et al.

(10) Patent No.: US 9,571,930 B2
(45) Date of Patent: Feb. 14, 2017

(54) AUDIO DATA DETECTION WITH A COMPUTING DEVICE

(71) Applicant: INTEL CORPORATION, Santa Clara, CA (US)

(72) Inventors: T V Rama Mohan Gupta, Bangalore (IN); Gangatharan Jothiswaran, Bangalore (IN); Prasanna Krishnaswamy, Bangalore (IN)

(73) Assignee: Intel Corporation, Santa Clara, CA (US)

( * ) Notice: Subject to any disclaimer, the term of this patent is extended or adjusted under 35 U.S.C. 154(b) by 299 days.

(21) Appl. No.: 14/140,354

(22) Filed: Dec. 24, 2013

(65) Prior Publication Data

US 2015/0181328 A1 Jun. 25, 2015

(51) Int. Cl.

| | |
|---|---|
| ***H04R 3/00*** | (2006.01) |
| *G10L 21/0316* | (2013.01) |
| *G10L 21/0216* | (2013.01) |

(52) U.S. Cl.

CPC ..... *H04R 3/005* (2013.01); *G10L 21/0316* (2013.01); *G10L 2021/02166* (2013.01); *H04R 2430/01* (2013.01)

(58) Field of Classification Search

USPC .... 381/2, 92, 77, 82, 95, 99, 102, 104, 120, 381/122; 700/94; 348/14.01, 14.02, 14.06

See application file for complete search history.

(56) References Cited

U.S. PATENT DOCUMENTS

| | | | | |
|---|---|---|---|---|
| 8,265,298 | B2 | 9/2012 | Ito et al. | |
| 8,452,019 | B1 | 5/2013 | Fomin et al. | |
| 2004/0170289 | A1 | 9/2004 | Whan | |
| 2005/0129262 | A1 | 6/2005 | Dillon et al. | |
| 2010/0278365 | A1 | 11/2010 | Biundo Lotito et al. | |
| 2012/0128175 | A1* | 5/2012 | Visser | H04R 3/005 381/92 |

OTHER PUBLICATIONS

International Search Report with Written Opinion received for PCT Patent Application No. PCT/US2014/067068, mailed on Feb. 26, 2015, 11 pages.

* cited by examiner

*Primary Examiner* — Vivian Chin
*Assistant Examiner* — Friedrich W Fahnert
(74) *Attorney, Agent, or Firm* — International IP Law Group, P.L.L.C.

(57) ABSTRACT

Various techniques for detecting are described herein. In one example, a method includes detecting a position of a computing device and selecting a plurality of microphones to detect audio data based on the position of the computing device. The method can also include calculating location data corresponding to the audio data, the location data indicating the location of a user and modifying a far field gain value based on the location data.

17 Claims, 5 Drawing Sheets

200

300

400

AUDIO DATA DETECTION WITH A COMPUTING DEVICE

BACKGROUND

Field

This disclosure relates generally to audio detection, and more specifically, but not exclusively, to detecting audio data in a computing device.

Description

Many computing devices include an increasing number of hardware components that can collect information related to the operating environment of a computing device. For example, some computing devices include sensors that can collect sensor data that indicates a location or orientation of a computing device. In some examples, the sensor data can be used to modify the execution of applications. For example, the sensor data may be used to modify the execution of an application based on the location of the computing device or the orientation of a computing device. In some embodiments, the sensor data can include audio data detected by microphones or any suitable audio sensor.

BRIEF DESCRIPTION OF THE DRAWINGS

The following detailed description may be better understood by referencing the accompanying drawings, which contain specific examples of numerous features of the disclosed subject matter.

DESCRIPTION OF THE EMBODIMENTS

According to embodiments of the subject matter discussed herein, a computing device can detect audio data. Audio data, as referred to herein, can include any data related to audio input from a user. For example, audio data may indicate the location of a user proximate a computing device, the orientation of the computing device to the user, a command from a user, or the number of users proximate a computing device, among others. In some examples, a computing device can detect the audio data using any suitable number of microphones. In some embodiments, the computing device may detect audio data using at least four microphones, wherein at least one microphone is located in a different plane in three dimensional space than the additional microphones.

Reference in the specification to "one embodiment" or "an embodiment" of the disclosed subject matter means that a particular feature, structure, or characteristic described in connection with the embodiment is included in at least one embodiment of the disclosed subject matter. Thus, the phrase "in one embodiment" may appear in various places throughout the specification, but the phrase may not necessarily refer to the same embodiment.

Figure 1:
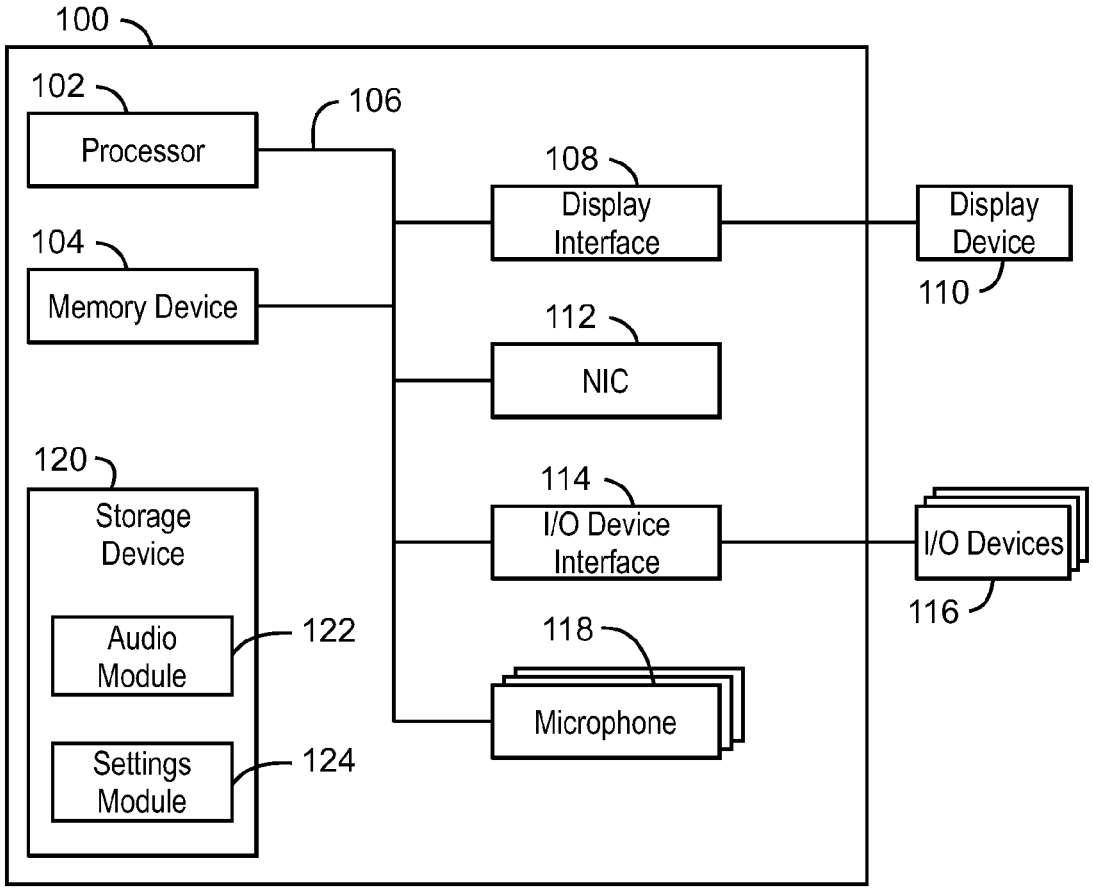
FIG. 1 is a block diagram of an example of a computing system that can detect audio data.

FIG. 1 is a block diagram of an example of a computing device that can detect audio data. The computing device 100 may be, for example, a mobile phone, laptop computer, desktop computer, or tablet computer, among others. The computing device 100 may include a processor 102 that is adapted to execute stored instructions, as well as a memory device 104 that stores instructions that are executable by the processor 102. The processor 102 can be a single core processor, a multi-core processor, a computing cluster, or any number of other configurations. The memory device 104 can include random access memory, read only memory, flash memory, or any other suitable memory systems. The instructions that are executed by the processor 102 may be used to implement a method that can detect audio data.

The processor 102 may also be linked through the system interconnect 106 (e.g., PCI®, PCI-Express®, HyperTransport®, NuBus, etc.) to a display interface 108 adapted to connect the computing device 100 to a display device 110. The display device 110 may include a display screen that is a built-in component of the computing device 100. The display device 110 may also include a computer monitor, television, or projector, among others, that is externally connected to the computing device 100. In addition, a network interface controller (also referred to herein as a NIC) 112 may be adapted to connect the computing device 100 through the system interconnect 106 to a network (not depicted). The network (not depicted) may be a cellular network, a radio network, a wide area network (WAN), a local area network (LAN), or the Internet, among others.

The processor 102 may be connected through a system interconnect 106 to an input/output (I/O) device interface 114 adapted to connect the computing device 100 to one or more I/O devices 116. The I/O devices 116 may include, for example, a keyboard and a pointing device, wherein the pointing device may include a touchpad or a touchscreen, among others. The I/O devices 116 may be built-in components of the computing device 100, or may be devices that are externally connected to the computing device 100.

The processor 102 may also be linked through the system interconnect 106 to one or more microphones 118. In some embodiments, the microphones 118 can detect any suitable audio data indicating characteristics of the operating environment of the computing device 100. For example, a microphone 118 may detect audio data related to the number of users proximate the computing device 100 and the location of the users, among others. In some examples, a computing device 100 may include multiple microphones 118, wherein each microphone 118 detects audio data from an area proximate the computing device 100.

In some embodiments, the processor 102 may also be linked through the system interconnect 106 to a storage device 120 that can include a hard drive, an optical drive, a USB flash drive, an array of drives, or any combinations thereof. In some embodiments, the storage device 120 can include an audio module 122 and a settings module 124. The audio module 122 can detect audio data from any suitable number of microphones 118. In some examples, the microphones 118 can be arranged as illustrated below in relation to system 300 of FIG. 3. For example, the audio module 122 may detect audio data from the area proximate a computing device 100 using at least three microphones that are located in a first plane in three dimensional space and at least one additional microphone located in a second plane in three dimensional space. In some examples, the audio module 122 can detect areas proximate a computing device 100 that do not produce audio data using any suitable technique, such as a delay-sum technique, among others. A delay-sum technique may determine a delay corresponding to audio data being detected by various microphones. The delay can indicate the location of the source of the audio data. The audio module 122 may disregard the areas that do not produce audio data since the areas likely do not include a user. In some examples, the audio module 122 can detect the location of a user based on the areas that produce audio data. The audio module 122 may store the location of the user as location data.

In some embodiments, the audio module 122 can detect the location data by analyzing a representation of the audio data received from the area surrounding the computing device 100. For example, the audio module 122 may generate a representation of the variations in audio data received from the area surrounding the computing device 100. The audio module 122 may also determine that an area with an amount of variation in audio data that is above a threshold value indicates the location of a user.

In some embodiments, the settings module 124 can detect audio data and location data from the audio module 122. In some examples, the audio module 122 can modify settings based on the audio data and the location data. For example, the settings module 124 may modify the gain by amplifying the audio data collected from areas near a location of a user. The settings module 124 may also disregard the noise or audio data collected from areas that do not correspond to the location of a user. In some examples, the settings module 124 can increase the sensitivity of microphones directed to the location of a user.

It is to be understood that the block diagram of FIG. 1 is not intended to indicate that the computing device 100 is to include all of the components shown in FIG. 1. Rather, the computing device 100 can include fewer or additional components not illustrated in FIG. 1 (e.g., additional memory components, embedded controllers, additional modules, additional network interfaces, etc.). Furthermore, any of the functionalities of the audio module 122 and the settings module 124 may be partially, or entirely, implemented in hardware and/or in the processor 102. For example, the functionality may be implemented with an application specific integrated circuit, logic implemented in an embedded controller, or in logic implemented in the processor 102, among others. In some embodiments, the functionalities of the audio module 122 and the settings module 124 can be implemented with logic, wherein the logic, as referred to herein, can include any suitable hardware (e.g., a processor, among others), software (e.g., an application, among others), firmware, or any suitable combination of hardware, software, and firmware.

Figure 2:
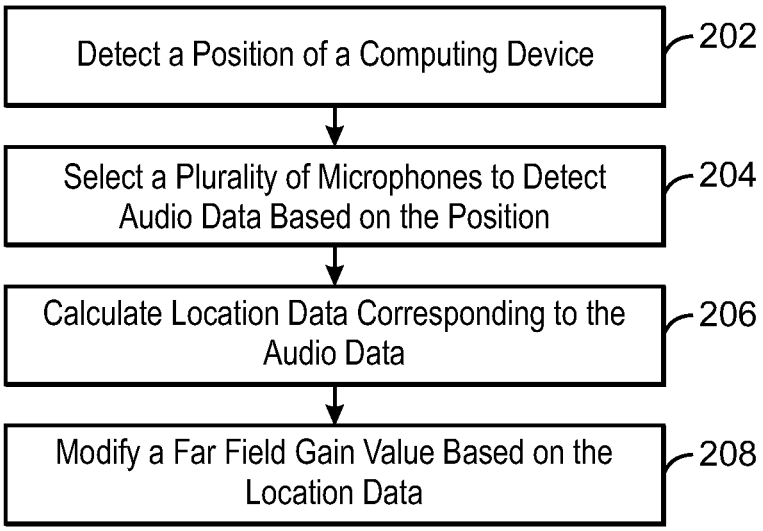
FIG. 2 is a process flow diagram of an example method for detecting audio data.

FIG. 2 is a process flow diagram of an example method for detecting audio data. The method 200 can be implemented with a computing device, such as the computing device 100 of FIG. 1.

At block 202, the audio module 122 can detect a position of a computing device. In some embodiments, the position of the computing device can include a flat position or an upright position, among others. The flat position may include any position of a computing device in which a display device is parallel to a keyboard or any position of a computing device in which the back of a display device is perpendicular to a user. The upright position may include any position in which the display device of a computing device is perpendicular to a keyboard or the back of the display device is parallel to a user. In some embodiments, the position of the computing device may also indicate if the portion of a display device with a screen (also referred to herein as the front of the display device) faces the detected audio data or if the audio data is detected from the back of the display device. In some embodiments, microphones are positioned along a display device so that the position of the display device can be used to determine which microphones are to collect audio data.

At block 204, the audio module 122 can select a plurality of microphones to detect audio data based on the position of the computing device. In some embodiments, the position of the computing device can indicate the microphones that are to be used to collect audio data. For example, the computing device may include any suitable number of microphones that detect audio data from different directions. In some embodiments, the audio module 122 can select the microphones based on the number of users proximate the computing device and the position of the users in relation to the computing device. The locations of the microphones are described in greater detail below in relation to FIG. 3.

At block 206, the audio module 122 can calculate location data corresponding to the audio data, the location data indicating the location of a user. As discussed above, the location data can indicate the coordinates or location of a user proximate a computing device. In some embodiments, the location data can be calculated using at least three equations and four microphones. The audio module 122 can calculate the location data using any suitable mathematical algorithm or technique, such as determining multiple circles of Apollonius, among others. An example of equations that can be used to calculate the location data is described in greater detail below in relation to FIG. 4.

At block 208, the settings module 124 can modify a far field gain value based on the location data. The far field gain value, as referred to herein, indicates the distance and location of audio data that are to be amplified. In some embodiments, the settings module 124 can modify the far field gain value to amplify the audio data from a location that corresponds to a user, which can enhance the audio input provided by a user. For example, the far field gain value may improve the accuracy for detecting audio commands and any other suitable audio input. In some embodiments, the settings module 124 can also implement an adaptive gain control mechanism that applies different gain curves from a predetermined table based on the distance and direction of the location data. In some embodiments, the settings module 124 can increase the reliability of voice recognition and increase the clarity of voice recording. The settings module 124 can also adjust the microphones so that a user can provide audio data to a computing device in any suitable position such as a flat position or an upright position, among others.

The process flow diagram of FIG. 2 is not intended to indicate that the operations of the method 200 are to be executed in any particular order, or that all of the operations of the method 200 are to be included in every case. Additionally, the method 200 can include any suitable number of additional operations. For example, the method 200 may also include determining, based on the location data, that two or more users are proximate the computing device and modifying the far field gain value to amplify the audio data collected from at least two locations. In some embodiments, the method 200 can include detecting that a computing device is at an angle between a flat position and an upright position and determining a combination of the microphones that are to collect audio data. In some embodiments, the location data indicates that a user is located in a field of view of a display device or the user is not located in the field of view of the display device. Additionally, in some examples, the modified far field gain value indicates the plurality of microphones are to amplify the audio data collected from the location of the user.

Figure 3:
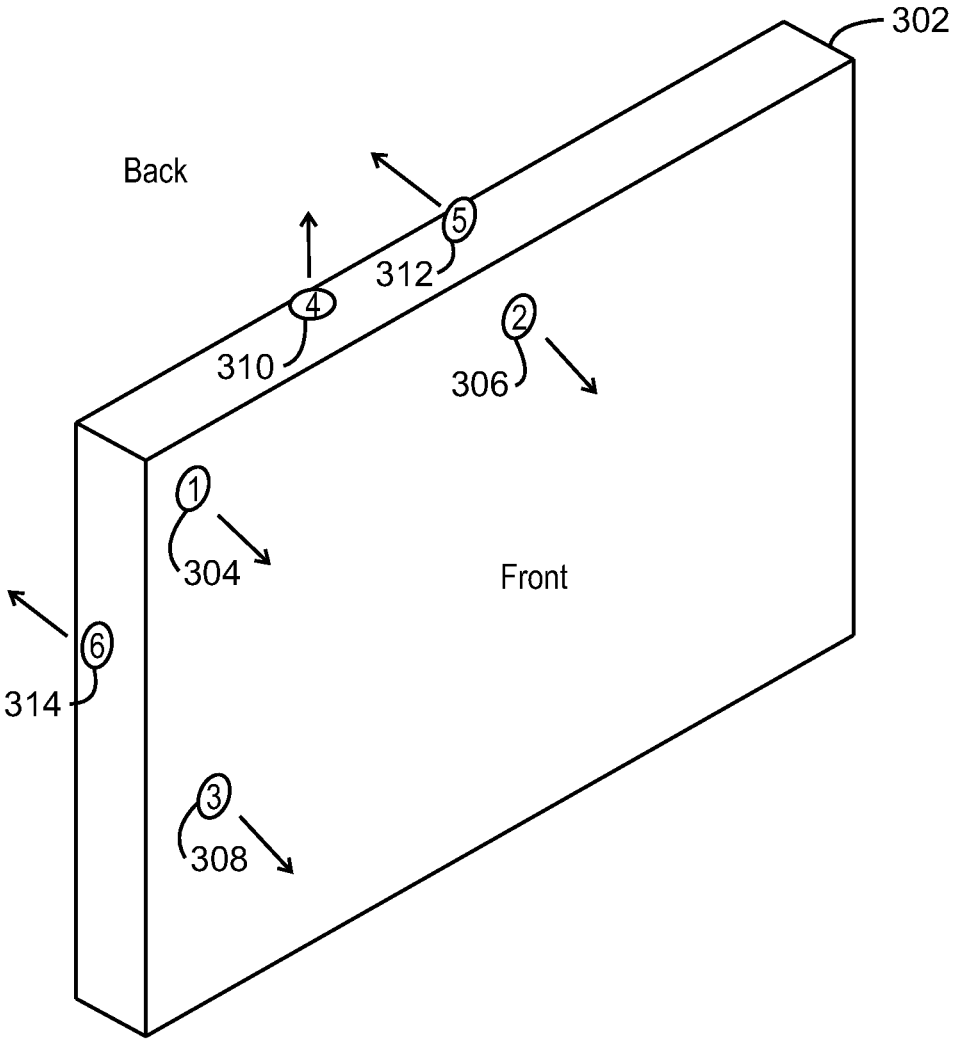
FIG. 3 is an illustration of an example of a system that can detect audio data with a combination of microphones.

FIG. 3 is an illustration of an example of a system that can detect audio data with a combination of microphones. The system 300 can include a display device 302 that may include any suitable number of microphones such as microphone 1 304, microphone 2 306, microphone 3 308, microphone 4 310, microphone 5 312, and microphone 6, 314. In some examples, the microphones 304-314 can be located at various positions within the display device 302. For example, the microphones 304-314 may be located on the front of a display device 302 the back of a display device 302, or any other suitable portion of the display device 302. The front of the display device 302, as referred to herein, includes the portion of the display device 302 that includes a screen that is viewable by a user. The back of the display device 302, as referred to herein, includes the portion of the display device that does not include a screen. For example, the back of the display device 302 may include a material that protects the backside of a screen.

In some embodiments, the microphones 304-314 are located in positions that enable the microphones 304-314 to capture audio data when the display device is in a position. For example, microphone 1 304, microphone 2 306, and microphone 4 310 can collect audio data that indicates if a user is located in front of the display device 302 or in the back of the display device 302 when the display device 302 is in an upright position. In some embodiments, microphone 1 304, microphone 2 306, microphone 3 308, and microphone 4 310 can collect audio data indicating the location of a user when the computing device is in a flat position or an upright position, among others. Microphone 1 304, microphone 2 306, microphone 3 308, and microphone 4 310 can also collect audio data indicating a far field gain value and a number of users that are proximate a computing device when the computing device is in a flat position or an upright position. In some examples, microphone 1 304, microphone 2 306, microphone 3 308, and microphone 4 310 can detect up to four users proximate a computing device.

In some embodiments, microphone 4 310, microphone 5 312, and microphone 6, 314 can collect audio data indicating the location data corresponding to a user proximate a computing device when the user is located in the back of the computing device in an upright position. Microphone 4 310, microphone 5 312, and microphone 6, 314 can also collect audio data indicating a far field gain value and a number of user proximate a computing device when the computing device is in an upright position and the users are in the back of the display device 302.

Figure 4:
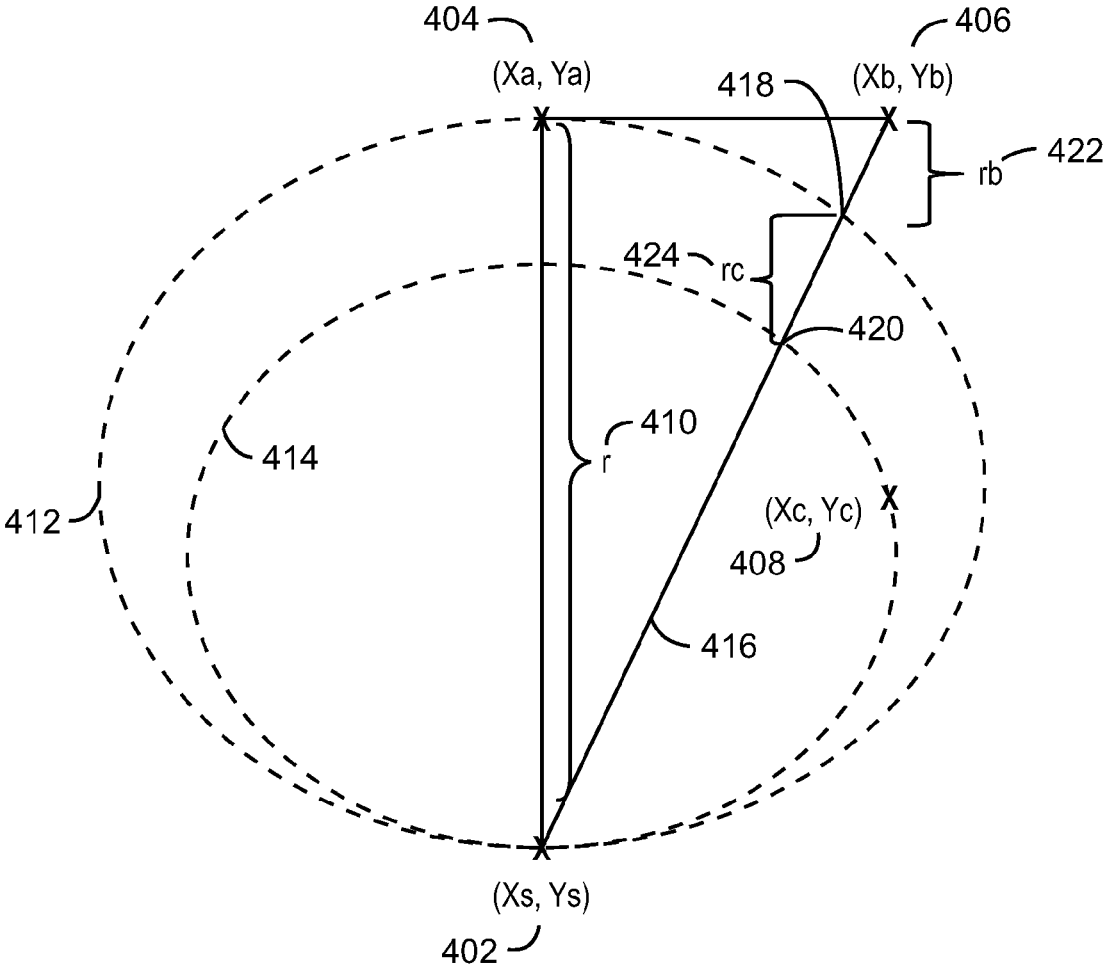
FIG. 4 is an example diagram illustrating aspects of the mathematical calculations used to determine location data corresponding to audio data.

FIG. 4 is an example diagram illustrating aspects of the mathematical calculations used to determine location data. In some embodiments, the audio module 122 can detect the location data corresponding to a user by using any suitable mathematical operation or equation. For example, the audio module 122 may calculate any suitable circle of Apollonius to determine a distance between a user and any suitable combination of microphones. In some examples, the distance between a user and the microphones is based on the delay associated with audio data being detected by the microphones. For example, the audio module 122 may use the following equations to calculate the location data:

$$(x_s-x_a)^2+(y_s-y_a)^2=(r+r_a)^2;\ r_a=0 \quad \text{Eq(1)}$$

$$(x_s-x_b)^2+(y_s-y_b)^2=(r+r_b)^2 \quad \text{Eq(2)}$$

$$(x_s-x_c)^2+(y_s-y_c)^2=(r+r_c)^2 \quad \text{Eq(3)}$$

In Eq(1), Eq(2), and Eq(3), the coordinates $(x_s, y_s)$ 402 represent the location data that indicates the location of a user. The coordinates $(x_a, y_a)$ 404 represent the location of a first microphone, the coordinates $(x_b, y_b)$ 406 represent the location of a second microphone, and the coordinates $(x_c, y_c)$ 408 represent the location of a third microphone. In some embodiments, the distance between $(x_s, y_s)$ 402 and $(x_a, y_a)$ 404 is referred to as "r" 410. In some examples, a first circle 412 can include the coordinates $(x_s, y_s)$ 402 and $(x_a, y_a)$ 404 and a second circle 414 can include the coordinates $(x_s, y_s)$ 402 and $(x_c, y_c)$ 408. Additionally, the audio module 122 may detect a line 416 between $(x_s, y_s)$ 402 and $(x_b, y_b)$ 406. The point at which the first circle 412 intersects the line 416 is referred to as point 1 418 and the point at which the second circle 414 intersects the line is referred to as point 2 420. The distance between $(x_b, y_b)$ 406 and point 1 418 is referred to as $r_b$ 422. The distance between $r_b$ 422 and point 2 420 is referred to as $r_c$ 424. The audio module 122 can use Eq(1), Eq(2), and Eq(3) to calculate the location data based on the delay corresponding to audio data. For example, the audio module 122 may detect audio data at the coordinates $(x_a, y_a)$ 404, $(x_b, y_b)$ 406, and $(x_c, y_c)$ 408, and use the equations to determine the coordinates $(x_s, y_s)$ 402.

Figure 5:
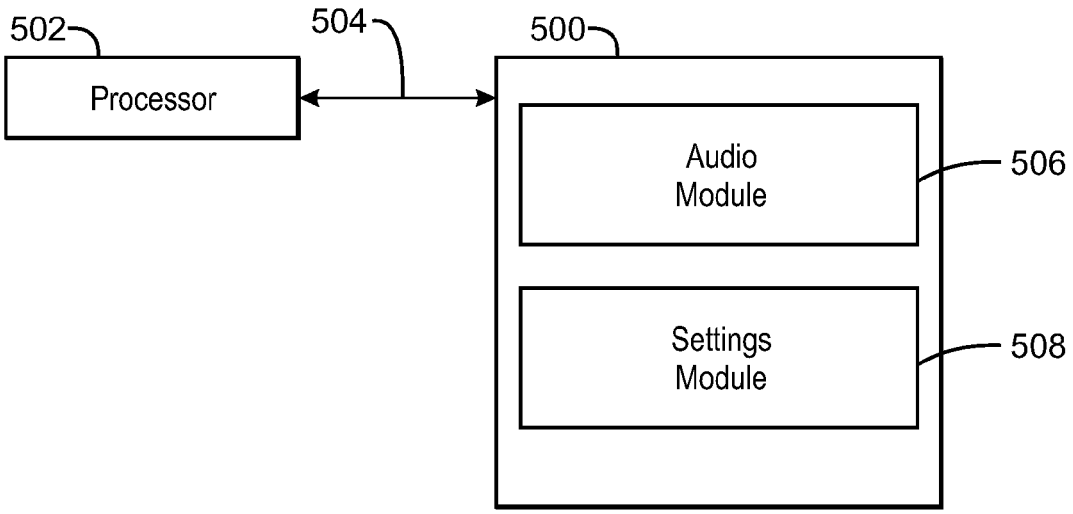
FIG. 5 is a block diagram depicting an example of a tangible, non-transitory computer-readable medium that can detect audio data.

FIG. 5 is a block diagram of an example of a tangible, non-transitory computer-readable medium that can detect audio data. The tangible, non-transitory, computer-readable medium 500 may be accessed by a processor 502 over a computer interconnect 504. Furthermore, the tangible, non-transitory, computer-readable medium 500 may include code to direct the processor 502 to perform the operations of the current method.

The various software components discussed herein may be stored on the tangible, non-transitory, computer-readable medium 500, as indicated in FIG. 5. For example, an audio module 506 may be adapted to direct the processor 502 to detect audio data from a combination of microphones and calculate location data that indicates the source of the audio data. In some embodiments, the source of the audio data can correspond to a user that provides audio input, such as commands, among others, to a computing device. A settings module 508 may be adapted to direct the processor 502 to adjust various settings based on the location data. For example, the settings module 508 may adjust a far field gain value that amplifies the audio data received from the location of a user.

It is to be understood that any suitable number of the software components shown in FIG. 5 may be included within the tangible, non-transitory computer-readable medium 500. Furthermore, any number of additional software components not shown in FIG. 5 may be included within the tangible, non-transitory, computer-readable medium 500, depending on the specific application.

Example 1

A method that can detect audio data is described herein. The method can include detecting a position of a computing device and selecting a plurality of microphones to detect audio data based on the position of the computing device. The method can also include calculating location data corresponding to the audio data, the location data indicating the location of a user, and modifying a far field gain value based on the location data.

In some embodiments, the method can include detecting a position for each of the plurality of microphones, the plurality of microphones comprising at least four microphones. In some examples, one microphone is positioned in a different plane than the at least three remaining microphones. The method can also include calculating the location data using at least three equations.

Example 2

A computing device to detect audio data is also described herein. In some examples, the computing device includes logic that can detect a position of a computing device and select a plurality of microphones to detect audio data based on the position of the computing device. The logic can also calculate location data corresponding to the audio data, the location data indicating the location of a user and modify a far field gain value based on the location data.

In some embodiments, the detected position comprises a flat position or an upright position. Additionally, in some examples, the modified far field gain value indicates the plurality of microphones that are to amplify the audio data collected from the location of the user.

Example 3

At least one non-transitory machine readable medium to detect audio data is also described herein. The at least one non-transitory machine readable medium may have instructions stored therein that, in response to being executed on an electronic device, cause the electronic device to detect a position of a computing device and select a plurality of microphones to detect audio data based on the position of the computing device. The at least one non-transitory machine readable medium may also have instructions stored therein that, in response to being executed on an electronic device, cause the electronic device to calculate location data corresponding to the audio data, the location data indicating the location of a user and modify a far field gain value based on the location data. In some embodiments, the instructions, in response to being executed on an electronic device, cause the electronic device to determine, based on the location data, that two or more users are proximate the computing device, and modify the far field gain value to amplify the audio data collected from at least two locations.

Although an example embodiment of the disclosed subject matter is described with reference to block and flow diagrams in FIGS. 1-5, persons of ordinary skill in the art will readily appreciate that many other methods of implementing the disclosed subject matter may alternatively be used. For example, the order of execution of the blocks in flow diagrams may be changed, and/or some of the blocks in block/flow diagrams described may be changed, eliminated, or combined.

In the preceding description, various aspects of the disclosed subject matter have been described. For purposes of explanation, specific numbers, systems and configurations were set forth in order to provide a thorough understanding of the subject matter. However, it is apparent to one skilled in the art having the benefit of this disclosure that the subject matter may be practiced without the specific details. In other instances, well-known features, components, or modules were omitted, simplified, combined, or split in order not to obscure the disclosed subject matter.

Various embodiments of the disclosed subject matter may be implemented in hardware, firmware, software, or combination thereof, and may be described by reference to or in conjunction with program code, such as instructions, functions, procedures, data structures, logic, application programs, design representations or formats for simulation, emulation, and fabrication of a design, which when accessed by a machine results in the machine performing tasks, defining abstract data types or low-level hardware contexts, or producing a result.

Program code may represent hardware using a hardware description language or another functional description language which essentially provides a model of how designed hardware is expected to perform. Program code may be assembly or machine language or hardware-definition languages, or data that may be compiled and/or interpreted. Furthermore, it is common in the art to speak of software, in one form or another as taking an action or causing a result. Such expressions are merely a shorthand way of stating execution of program code by a processing system which causes a processor to perform an action or produce a result.

Program code may be stored in, for example, volatile and/or non-volatile memory, such as storage devices and/or an associated machine readable or machine accessible medium including solid-state memory, hard-drives, floppy-disks, optical storage, tapes, flash memory, memory sticks, digital video disks, digital versatile discs (DVDs), etc., as well as more exotic mediums such as machine-accessible biological state preserving storage. A machine readable medium may include any tangible mechanism for storing, transmitting, or receiving information in a form readable by a machine, such as antennas, optical fibers, communication interfaces, etc. Program code may be transmitted in the form of packets, serial data, parallel data, etc., and may be used in a compressed or encrypted format.

Program code may be implemented in programs executing on programmable machines such as mobile or stationary computers, personal digital assistants, set top boxes, cellular telephones and pagers, and other electronic devices, each including a processor, volatile and/or non-volatile memory readable by the processor, at least one input device and/or one or more output devices. Program code may be applied to the data entered using the input device to perform the described embodiments and to generate output information. The output information may be applied to one or more output devices. One of ordinary skill in the art may appreciate that embodiments of the disclosed subject matter can be practiced with various computer system configurations, including multiprocessor or multiple-core processor systems, minicomputers, mainframe computers, as well as pervasive or miniature computers or processors that may be embedded into virtually any device. Embodiments of the disclosed subject matter can also be practiced in distributed computing environments where tasks may be performed by remote processing devices that are linked through a communications network.

Although operations may be described as a sequential process, some of the operations may in fact be performed in parallel, concurrently, and/or in a distributed environment, and with program code stored locally and/or remotely for access by single or multi-processor machines. In addition, in some embodiments the order of operations may be rearranged without departing from the spirit of the disclosed subject matter. Program code may be used by or in conjunction with embedded controllers.

While the disclosed subject matter has been described with reference to illustrative embodiments, this description is not intended to be construed in a limiting sense. Various modifications of the illustrative embodiments, as well as other embodiments of the subject matter, which are apparent to persons skilled in the art to which the disclosed subject matter pertains are deemed to lie within the scope of the disclosed subject matter.

What is claimed is:

1. A method for detecting audio data comprising:
detecting a position of a computing device;
selecting a plurality of microphones to detect audio data based on the position of the computing device;
calculating location data corresponding to the audio data, the location data indicating the locations of two or more users; and
modifying a far field gain value based on the location data and the position of the computing device, wherein modifying the far field gain comprises amplifying the audio data based on the locations of the two or more users.

2. The method of claim 1, comprising detecting a position for each of the plurality of microphones, the plurality of microphones comprising at least four microphones.

3. The method of claim 2, wherein one microphone is positioned in a different plane than the at least three remaining microphones.

4. The method of claim 2, comprising calculating the location data using at least three equations.

5. The method of claim 1, wherein the position comprises a flat position or an upright position.

6. The method of claim 1, wherein the location data indicates that at least one of the two users is located in a field of view of a display device or at least one of the two users is not located in the field of view of the display device.

7. The method of claim 1, comprising:
determining, based on the location data, that the two or more users are proximate the computing device.

8. A computing device to detect audio data, comprising:
logic to:
detect a position of a computing device;
select a plurality of microphones to detect audio data based on the position of the computing device;
calculate location data corresponding to the audio data, the location data indicating the locations of two or more users; and
modify a far field gain value based on the location data and the position of the computing device, wherein modifying the far field gain comprises amplifying the audio data based on the locations of the two or more users.

9. The computing device of claim 8, wherein the logic is to detect a position for each of the plurality of microphones, the plurality of microphones comprising at least four microphones.

10. The computing device of claim 9, wherein one microphone is positioned in a different plane than the at least three remaining microphones.

11. The computing device of claim 9, wherein the logic is to calculate the location data using at least three equations.

12. The computing device of claim 8, wherein the position comprises a flat position or an upright position.

13. The computing device of claim 8, wherein the logic is to:
determine, based on the location data, that the two or more users are proximate the computing device.

14. At least one non-transitory machine readable medium having instructions stored therein that, in response to being executed on an electronic device, cause the electronic device to:
detect a position of a computing device;
select a plurality of microphones to detect audio data based on the position of the computing device;
calculate location data corresponding to the audio data, the location data indicating the locations of two or more users; and
modify a far field gain value based on the location data and the position of the computing device, wherein modifying the far field gain comprises amplifying the audio data based on the locations of the two or more users and applying a plurality of gain curves from a predetermined table based on a distance and a direction of the two or more users.

15. The at least one non-transitory machine readable medium of claim 14, wherein the instructions, in response to being executed on an electronic device, cause the electronic device to detect a position for each of the plurality of microphones, the plurality of microphones comprising at least four microphones.

16. The at least one non-transitory machine readable medium of claim 15, wherein one microphone is positioned in a different plane than the at least three remaining microphones.

17. The at least one non-transitory machine readable medium of claim 14, wherein the instructions, in response to being executed on an electronic device, cause the electronic device to:
determine, based on the location data, that the two or more users are proximate the computing device.

* * * * *